US009464505B2

(12) United States Patent
Anyan et al.

(10) Patent No.: US 9,464,505 B2
(45) Date of Patent: Oct. 11, 2016

(54) FLOW CONTROL SYSTEM WITH VARIABLE STAGED ADJUSTABLE TRIGGERING DEVICE

(71) Applicant: Schlumberger Technology Corporation, Sugar Land, TX (US)

(72) Inventors: Steven L. Anyan, Missouri City, TX (US); Ricardo Martinez, Spring, TX (US); Tauna Leonardi, Pearland, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 542 days.

(21) Appl. No.: 13/722,751

(22) Filed: Dec. 20, 2012

(65) Prior Publication Data

US 2013/0327537 A1 Dec. 12, 2013

Related U.S. Application Data

(60) Provisional application No. 61/657,540, filed on Jun. 8, 2012.

(51) Int. Cl.

| | |
|---|---|
| ***E21B 34/00*** | (2006.01) |
| ***E21B 34/06*** | (2006.01) |
| ***E21B 34/10*** | (2006.01) |
| ***E21B 34/08*** | (2006.01) |
| ***E21B 34/14*** | (2006.01) |

(52) U.S. Cl.

CPC ..... *E21B 34/06* (2013.01); *E21B 34/063* (2013.01); *E21B 34/08* (2013.01); *E21B 34/101* (2013.01); *E21B 34/102* (2013.01); *E21B 34/103* (2013.01); *E21B 34/14* (2013.01); *E21B 2034/002* (2013.01)

(58) Field of Classification Search

CPC .. E21B 34/101; E21B 34/102; E21B 34/103; E21B 34/002; E21B 34/06

See application file for complete search history.

(56) References Cited

U.S. PATENT DOCUMENTS

| | | | | |
|---|---|---|---|---|
| 4,249,601 | A * | 2/1981 | White | 166/208 |
| 5,787,979 | A | 8/1998 | Giroux et al. | |
| 5,924,490 | A * | 7/1999 | Stone | 166/312 |
| 6,260,627 | B1 | 7/2001 | Rivas | |
| 6,293,342 | B1 | 9/2001 | McGarian et al. | |
| 6,394,183 | B1 | 5/2002 | Schrenkel et al. | |

(Continued)

FOREIGN PATENT DOCUMENTS

| | | |
|---|---|---|
| CN | 101328794 | 12/2008 |

OTHER PUBLICATIONS

International Search Report and Written Opinion mailed on Sep. 4, 2013 for International Patent Application No. PCT/US2013/043228, filed on May 30, 2013, 13 pages.

*Primary Examiner* — Robert E Fuller
*Assistant Examiner* — Steven MacDonald
(74) *Attorney, Agent, or Firm* — David J. Groesbeck

(57) ABSTRACT

Techniques and equipment to facilitate controlling flow of a fluid along a flow passage. A flow control assembly is placed along a flow passage, and a bypass is routed past the flow control assembly. Flow along the bypass is controlled by a flow bypass mechanism which may be operated via pressure increase within the flow control assembly. A shear device restricts the opening of the bypass, and a dampening device acts to limit the shear device to exposure of forces from the pressure increase.

12 Claims, 6 Drawing Sheets

(56) References Cited

U.S. PATENT DOCUMENTS

| | | | |
|---|---|---|---|
| 6,575,246 | B2 | 6/2003 | Bixenman et al. |
| 6,588,502 | B2 | 7/2003 | Nice |
| 6,655,461 | B2 | 12/2003 | Eslinger et al. |
| 6,675,897 | B1 | 1/2004 | McGarian et al. |
| 6,899,179 | B2 | 5/2005 | McGarian et al. |
| 7,055,606 | B2 | 6/2006 | Goode et al. |
| 7,748,462 | B2 | 7/2010 | Reid |
| 2004/0159447 | A1 | 8/2004 | Bissonnette et al. |
| 2006/0231256 | A1 | 10/2006 | Rivas et al. |
| 2012/0018172 | A1 | 1/2012 | Javed |
| 2013/0269928 | A1* | 10/2013 | Zhou ..... 166/113 |

* cited by examiner 82
72
73
74
78
75
64
56
60
58
61
50
70

FLOW CONTROL SYSTEM WITH VARIABLE STAGED ADJUSTABLE TRIGGERING DEVICE

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled, various forms of well completion components may be installed in order to control and enhance the efficiency of producing the various fluids from the reservoir. In a variety of downhole applications, flow control devices, e.g. in-line barrier valves, are used to control flow along the well system. Accidental or inadvertent closing or opening of in-line barrier valves can result in a variety of well system failures. In some applications, adverse formation issues may occur in a manner that initiates pumping of heavier fluid for killing of the reservoir. In such an event, the in-line barrier valve is opened to allow pumping of kill weight fluid.

SUMMARY

In general, the present disclosure provides a system and method for controlling flow, e.g. controlling flow along a wellbore. A flow control assembly, e.g. an in-line barrier valve, is placed along a flow passage. A bypass is routed past the flow control assembly. Flow along the bypass is controlled via a flow bypass mechanism which may be operated interventionless by, for example, pressure, e.g. a pressure differential, pressure pulse, absolute pressure, or other suitable interventionless technique. The interventionless application of pressure is used to actuate the flow bypass mechanism to selectively allow flow through the bypass. The flow bypass mechanism may include a shearable member, which responds to a set pressure signal by shearing, thereby allowing the flow bypass mechanism to selectively allow the flow through the bypass. A dampening device may be provided to limit the shear member exposure to forces from pressure signals or increases that are not intended for the actuation of the flow bypass mechanism.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments will hereafter be described with reference to the accompanying drawings, wherein like reference numerals denote like elements. It should be understood, however, that the accompanying drawings illustrate only the various implementations described herein and are not meant to limit the scope of various technologies described herein.

DETAILED DESCRIPTION

Figure 1:
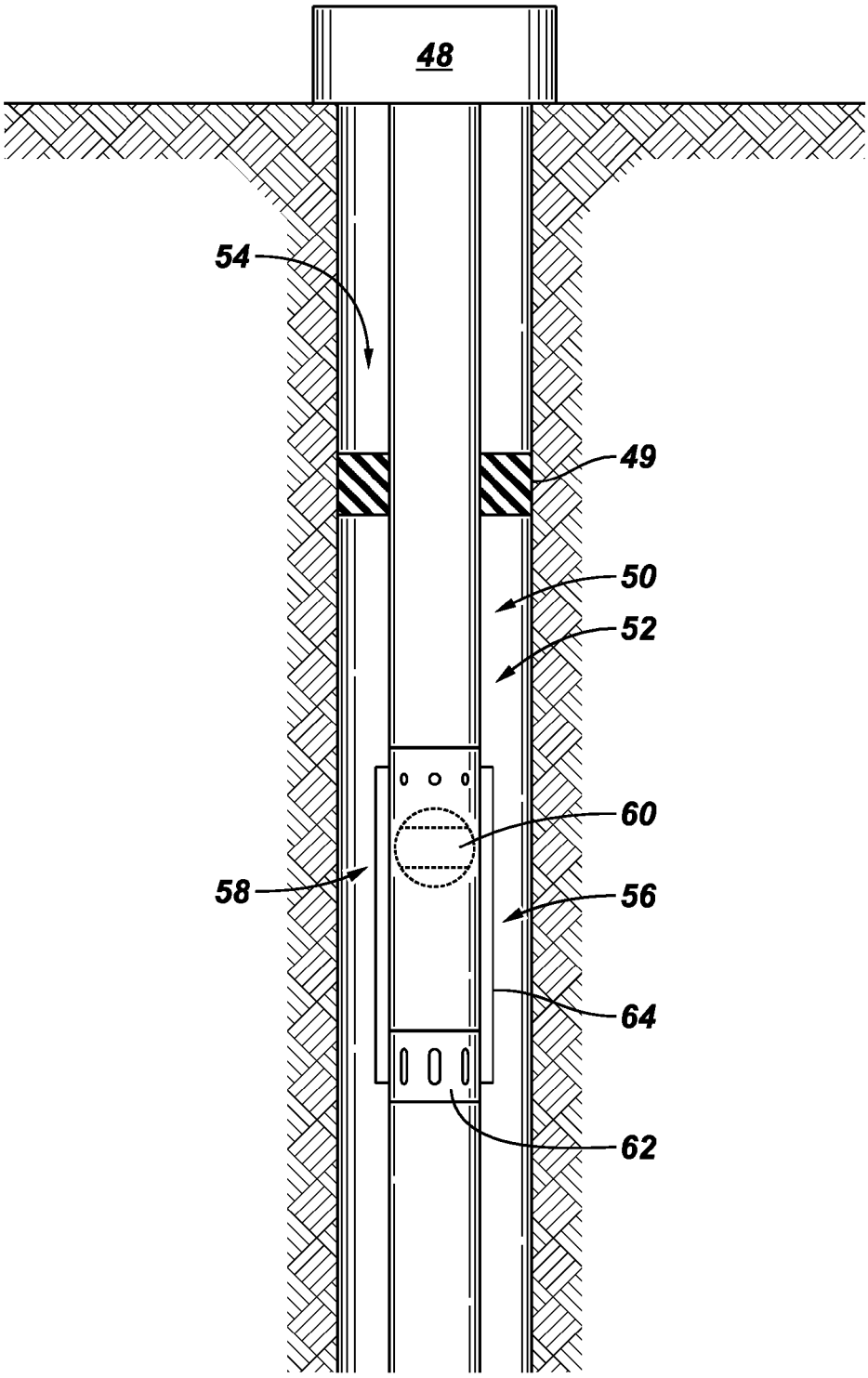
FIG. 1 is an illustration of an embodiment of a well system having an in-line barrier valve, according to an embodiment of the disclosure.

In the following description, numerous details are set forth to provide an understanding of the present invention. However, it will be understood by those skilled in the art that the present system and/or methodology may be practiced without these details and that numerous variations or modifications from the described embodiments may be possible.

In the specification and appended claims: the terms "couple", "coupling", "coupled", "coupled together", and "coupled with" are used to mean "directly coupled together" or "coupled together via one or more elements". As used herein, the terms "up" and "down", "upper" and "lower", "upwards" and downwards", "upstream" and "downstream"; "above" and "below"; and other like terms indicating relative positions above or below a given point or element are used in this description to more clearly describe some embodiments. However, when applied to equipment and methods for use in environments that are deviated or horizontal, such terms may refer to a left to right, right to left, or other relationship as appropriate. Likewise, when viewed in light of the associated figures it should be understood that orientation of the drawings is optimized for presentation on the printed page, and therefore the orientation shown may differ from that described or desired in real world applications, at least with respect to orientation directions such as "up", "down", etc.

The disclosure herein generally involves a system and methodology related to controlling flow along a passage, such as a wellbore. A variety of in-line flow control devices may be controlled via various inputs from, for example, a surface location. Examples of in-line flow control devices include ball valves, flapper valves, sliding sleeves, disc valves, other flow control devices, or various combinations of these devices. The system also may utilize a bypass positioned to route fluid flow around one or more of the in-line flow control devices during certain procedures. A variety of flow bypass mechanisms may be selectively controlled to block or enable flow through the bypass. Control over the in-line flow control devices and the flow bypass mechanisms facilitate a variety of operational and testing procedures.

The in-line flow control devices and the bypass systems may be used in many types of systems including well systems and non-well related systems. In some embodiments, the in-line flow control device(s) is combined with a well system, such as a well completion system to control flow. For example, in-line flow control devices and bypass systems may be used in upper completions or other completion segments of a variety of well systems, as described in greater detail below.

According to an embodiment of the disclosure, a method is provided for isolating a tubing zone with a barrier valve which may enable testing and/or well control of the tubing zone. The method further comprises the use of a flow bypass mechanism to selectively reveal a flow path circumventing the barrier. The mechanism may be activated by various interventionless techniques, including use of pressure, e.g. a pressure increase, in the tubing string to overcome a differential pressure. When a certain designated pressure (or pressure differential) is introduced in the tubing string, a shear device present in the flow bypass mechanism, which serves to restrict the opening of the bypass, will shear through a shear mode and allow the flow bypass mechanism to reveal a flow path circumventing the barrier. Shear device is intended to operate only (e.g. shear) in response to the designated pressure (or pressure differential). A dampening device is provided to limit the shear devices exposure to pressure increases that are less than the designated pressure (or pressure differential) increase, as well as to other downhole events (e.g. forces, impacts, or translations resulting from installation of the flow control assembly).

Referring generally to FIG. 1 a flow control system is illustrated as comprising a well system. The well system can be used in a variety of well applications, including onshore applications and offshore applications. In this example, a flow control system 50 comprises or is formed within a well system 52 deployed in a wellbore 54. The flow control system 50 comprises a variety of components for controlling flow through the well system 52. Well system 52 may also include other components such as wellhead 48 and packer 49.

In the example illustrated, well system 52 comprises a barrier valve system 56 that is controlled from the surface. The barrier valve system 56 utilizes an in-line barrier valve 58 having a primary barrier which may be in the form of a ball valve 60. The ball valve 60 is suitably rated for high-pressure tubing zone testing and/or well control that can be performed to validate uphole equipment. The primary barrier valve, e.g. ball valve 60, can be actuated numerous times as desired for testing or other procedures. Also, the ball valve 60 may be designed as a bidirectional ball valve that can seal in either direction.

In the example illustrated, the well system 52 further comprises a flow bypass mechanism 62 which may be selectively moved between a blocking position and an open flow position. The flow bypass mechanism is used to selectively block or enable flow along a bypass 64 which, when opened, allows fluid to bypass the ball valve 60. In the example illustrated, bypass 64 routes fluid past or around ball valve 60 even when ball valve 60 is in a closed position, as illustrated in FIG. 1. Such a bypass may be utilized in numerous operations scenarios, for example, when the ball valve 60 fails in a closed position and it is desirable to pump kill fluids into the well below the ball valve 60.

Figure 2:
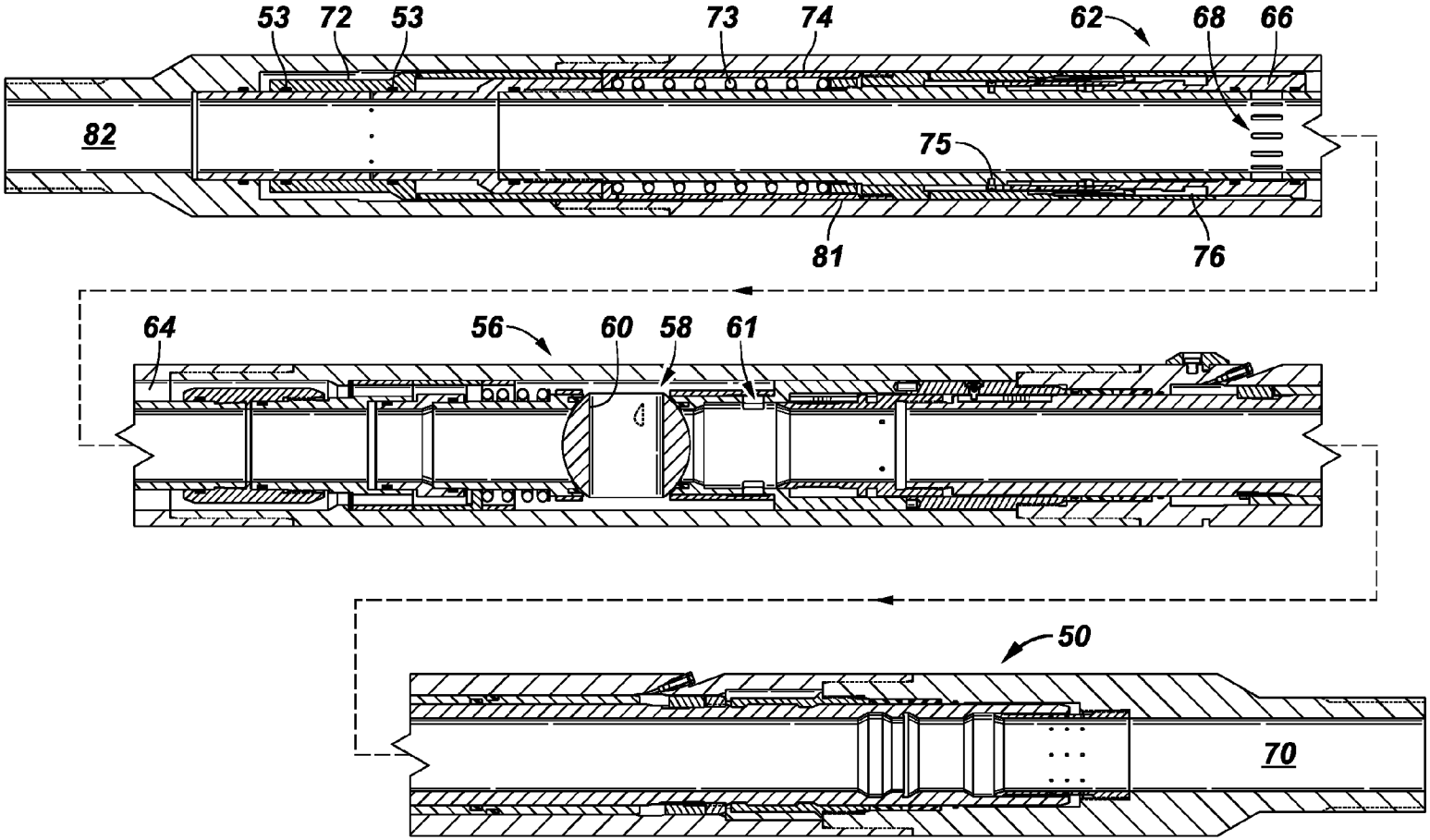
FIG. 2 is an illustration of an embodiment of an operational state of a barrier valve system with bypass option, according to an embodiment of the disclosure.

Referring now to FIG. 2, an embodiment of a flow control system 50, and in particular, of the barrier valve system 56 and other associated components, is shown. As described above, flow control system 50 includes a flow bypass mechanism 62 which may be selectively moved or actuated to allow flow to bypass the ball valve 60. The flow bypass mechanism 62 may comprise a port blocking member 66 which is positioned to selectively block or allow flow through corresponding ports 68. Port blocking member 66 may be in the form of a sliding sleeve or other suitable member designed to selectively prevent or enable flow through the corresponding ports 68. When the port blocking member 66 is moved to expose ports 68, the ports 68 allow fluid flow between an internal primary flow passage 70, through bypass entry 61, and into bypass 64 to enable fluid to flow past the closed ball valve 60. In the embodiment illustrated, port blocking member 66 cooperates with power piston 72, which may be actuated or shifted by a suitable pressure application to allow the port blocking member 66 to move from blocking ports 68. The suitable pressure application may be transmitted to power piston 72 through internal primary flow passage 70 and bypass 64. Power piston seals 53 are provided to allow suitable pressure to remain in the flow control system 50, and act against power piston 72.

The power piston 72 may comprise any suitable type of piston which reacts to pressure, e.g. an increase in the tubing pressure above a certain designated pressure. In practice, the designated pressure may be chosen such that it is a pressure not normally seen in the tubing during the normal course of operations. Power piston 72 may shift in a first direction (e.g. move upwards) in response to the designated pressure, and in doing so may interface with a dampening device 73, and actuator assembly 74. In some embodiments, the actuator assembly is disposed between power piston 72 and dampening device 73 such that physical contact occurs between the actuator assembly 74 and the power piston 72. Actuator assembly 74 may be a single piece or for ease of manufacture, may be made up of several pieces coupled together. Initially, dampening device 73 restricts force or translation from the power piston 72 from being transmitted to shear device 75, as will be described in greater detail below. Actuator assembly 74 may engage shear device 75, which restricts the further motion of both the actuator assembly 74, and an engagement member 76 which may be attached (e.g. threaded connection) to actuator assembly 74. Alternately, engagement member 76 may be a machined part of actuator assembly 74. Once movement is no longer restrained by the shear device 75, engagement member 76 may engage with port blocking member 66 (e.g. sliding sleeve). After this engagement occurs, a reduction in pressure in the tubing to below the designated level will allow the power piston to shift in a second direction (e.g. move downwards), thereby allowing port blocking member 66 to shift and expose ports 68. Once exposed, ports 68 allow fluid to flow between the internal primary flow passage 70 and bypass 64, which thereby enables fluid to flow past the closed ball valve 60.

Shear device 75 restricts the opening of port blocking member 66, at least in part by restricting the motion of engagement member 76 and sufficient force must be applied to shear device 75 to cause it to function through a shear mode, and allow engagement member 76 to engage with port blocking member 66. In some embodiments, shear device 75 is a shear pin or other type of shear mode functioning device. Shear device 75 may be of varying designs, cross sections, materials, etc depending on the amount of force desired for its function, and may include multiple shear pins or shear mode failure devices.

Dampening device 73 limits the forces transmitted to shear device 75, such that most forces associated with pressures lower than a designated or design pressure are not transmitted to shear device 75. Dampening device 73 does this by generating a counter force to that supplied by power piston 72. This limits the possibility of shear device 75 prematurely shearing, for example, due to cyclic loading from forces/pressures less than the designated or design ones, and therefore reducing the shear pin ability to withstand force prior to functioning. This also limits the possibly of shear device 75 prematurely functioning due to impacts or jarring which may occur during flow control system 50 installation in well system 52. In some embodiments, the presence of dampening device 73 in flow control system 50 may allow for a smaller shear device or less shear members to be used than would be possible absent dampening device 73 presence.

In some embodiments, and as shown, dampening device 73 may be a spring, while in other embodiments dampening device 73 may be another type of biasing member, including without limitations, an elastomer, a foam, a fluid spring, a gas spring, a Belleville washer, a wave spring, etc. A variable adjustment member 81 may also be used in cooperation with dampening device 73, in order to change or modify (before installation) the dampening device 73 properties. In some embodiments, variable adjustment member 81 may be a nut or washers used to compress a dampening device spring, thereby changing the possible amount of spring force or counter force generated by dampening device 73. By changing the counter force generated by dampening device 73, the overall designated pressure point for opening of the bypass 64 may be changed.

It should therefore be recognized that in order for the flow bypass mechanism 62 to selectively allow flow along the bypass 64 the designated pressure must be at least great enough to generate a sufficient force, through power piston 72, to overcome the counter force of dampening device 73, to shift or translate the various members described herein (e.g. power piston 72, actuator member 74, etc) and to shear the shear members of shear device 75. Shear device 75 is able to withstand a certain amount of force (and therefore pressure increase) after dampening device 73 has been overcome. These factors may be optimized by design to obtain a desired designated pressure, and may be optimized such that designated pressure is unlikely to be encountered during normal course of well operations (e.g. only present when flow bypass operation is desired). In some embodiments, prior to opening of the bypass 64 a portion of the designated pressure increase will be withstood by the dampening system 73 acting alone, while a portion of the designated pressure increase will be withstood by the shear device 75 acting with dampening system 73.

Figure 3:
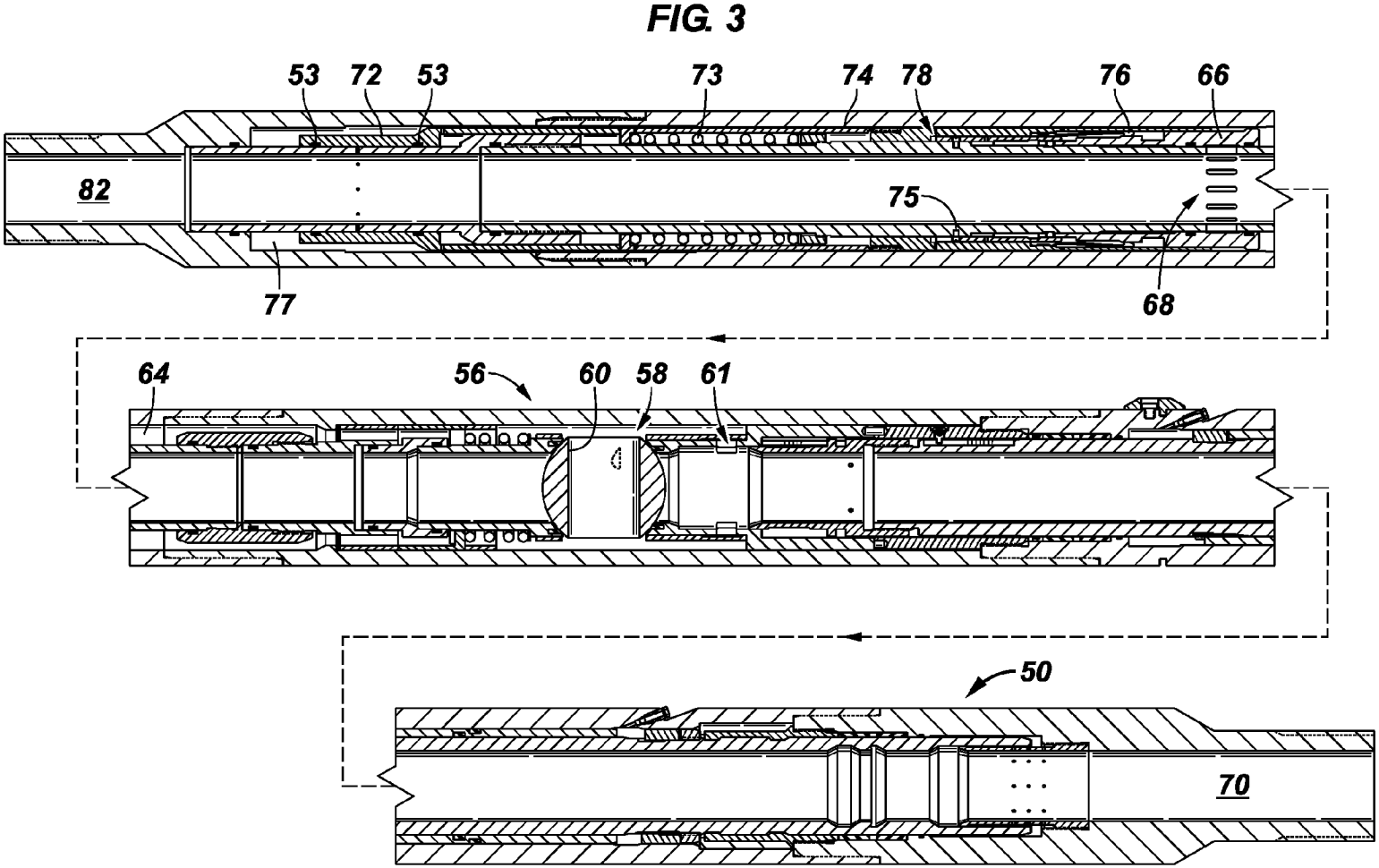
FIG. 3 is another illustration of an embodiment of an operational state of a barrier valve system with bypass option, according to an embodiment of the disclosure.

Referring now to FIG. 3, an embodiment of a flow control system 50, and in particular, of the flow bypass mechanism 62 and other associated components, is shown. In the example illustrated, a pressure has been increased in the internal primary flow passage (e.g. tubing) 70, and power piston 72 has shifted from its initial position (as shown in FIG. 2). The pressure increase was communicated to power piston 72 through internal primary flow passage 70 and bypass 64. Power piston seals 53 allow the pressure increase at least in chamber 77 to act against power piston 72. In response, power piston 72 shifted in a first direction (e.g. upwards) until it encountered actuator assembly 74, which is partly disposed between the power piston 72 and dampening device 73. Dampening device 73 resists the upward motion of the power piston by exerting a counter force (e.g. spring force) in the opposite direction. As shown in FIG. 3, the dampening device 73 counter force is sufficient to limit shear device 75 exposure, in that actuator assembly 74 does not contact shear device 75. Variable gap 78 between shear device 75 and actuator assembly 74 shows that forces are not yet being transmitted from power piston 72 and actuator assembly 74 to shear device 75. If pressure in the internal flow passage 70 were reduced at this point, the counter force from dampening device 73 would force the power piston 72 back in a second direction (e.g. downwards), to the initial position. These types of pressure increases (i.e. which are not transmitted to shear device 75) could occur numerous times in the life of the deployed barrier valve system 56, without allowing the bypass 64 to open. Further, as pressure increases are not transmitted to shear device 75, shear device 75 is protected from inadvertent cyclic loading which could lead to fatigue.

Figure 4:
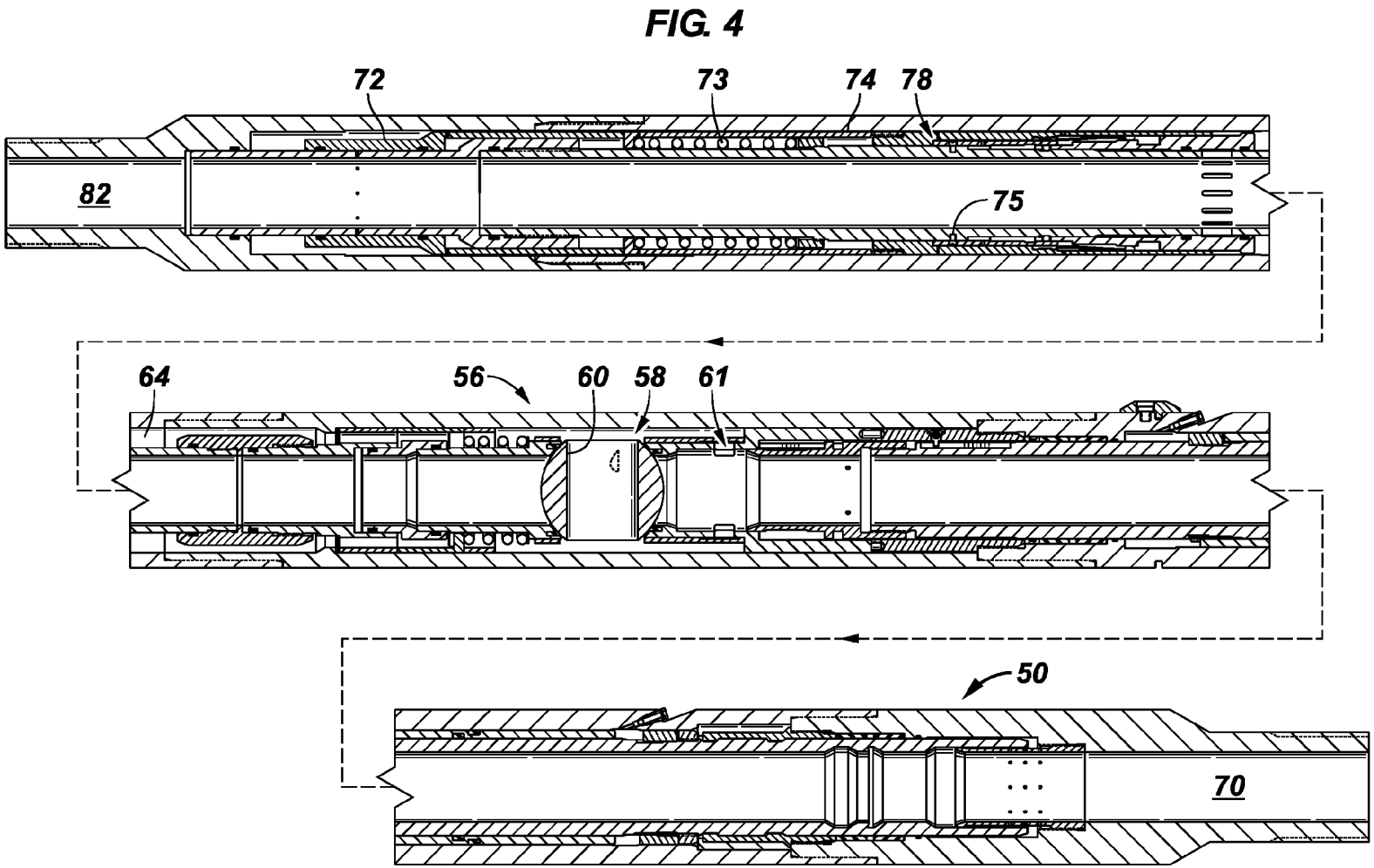
FIG. 4 is another illustration of an embodiment of an operational state of a barrier valve system with bypass option, according to an embodiment of the disclosure.

Referring now to FIG. 4, an embodiment of a system where sufficient pressure to overcome the dampening device 73 counter force is shown. In the illustrated example, pressure in internal primary flow passage 70 was raised to a point sufficient to shift power piston 72 upwards, overcome the counter force supplied by dampening device 73, and close variable gap 78 such that actuator assembly 74 was brought into contact with shear device 75. In some embodiments, once shear device 75 is in contact with actuator assembly 74, and dampening device 73 is fully compressed (e.g. a fully compressed spring) then all additional or further force applied (e.g. pressure increased) will work to cause shear device 75 shear members to function through their desired shear modes. In some embodiments where dampening device 73 is not fully compressed (e.g. a partially compressed spring), then the additional or further force applied will be shared or split between both causing the shear device 75 shear members to function through their desired shear modes, and between further compressing dampening device 73 (e.g. overcoming its generated counterforce).

Figure 5:
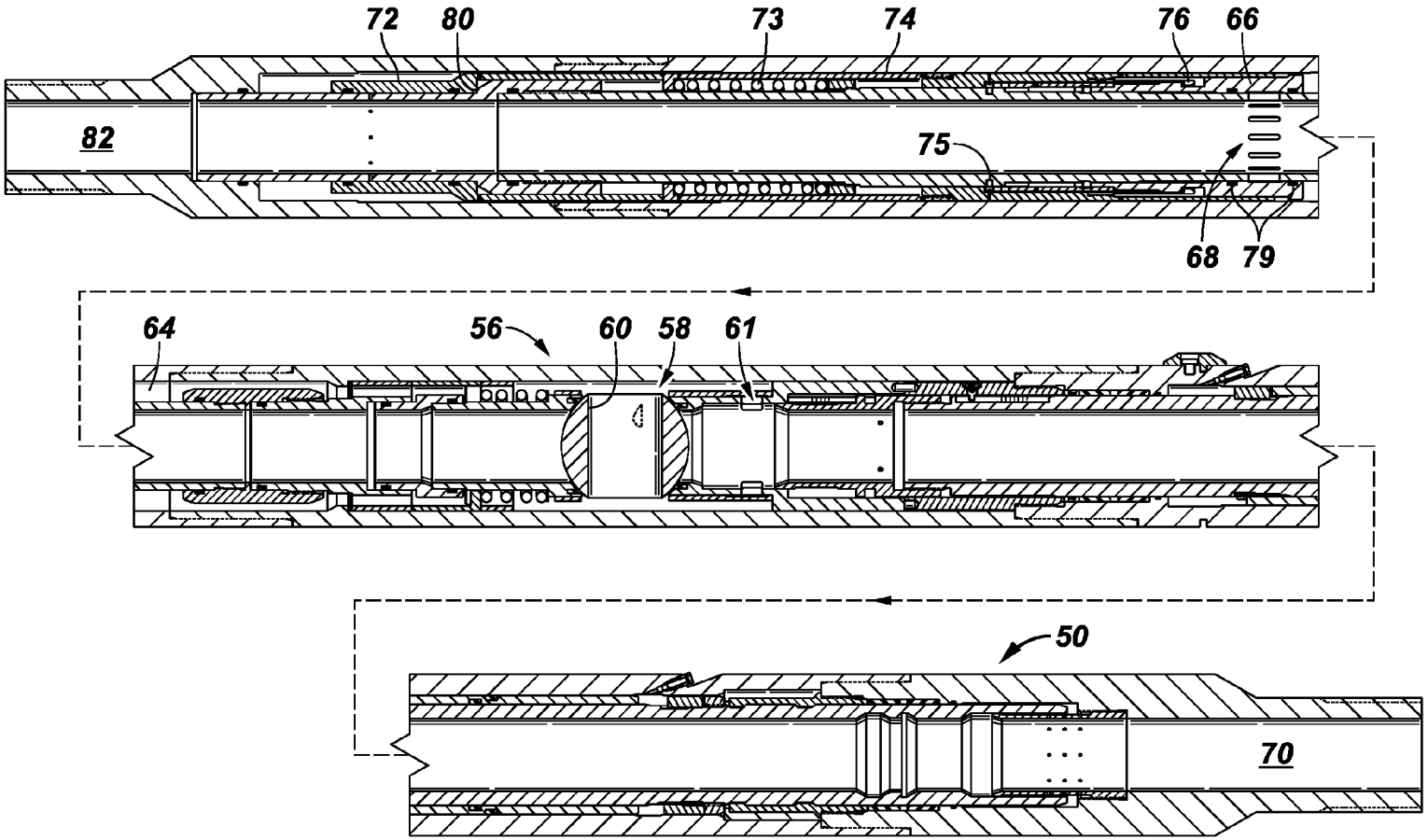
FIG. 5 is another illustration of an embodiment of an operational state of a barrier valve system with bypass option, according to an embodiment of the disclosure.

Turning now to FIG. 5, an embodiment of a system where shear device 75 has been overcome is shown. In the illustrated example, pressure in the internal primary flow passage 70 was sufficient to shift power piston 72 upwards, overcoming the counter force supplied by dampening device 73 and cause shear device 75 shear members to shear. Once this occurs, shear device 75 allows the engagement member portion 76 of actuator assembly 74 to translate upwards and engage with port blocking member 66, for example through a collet/finger type engagement. Power piston 72 shifting is then stopped by shoulder 80, such that any additional increase in pressure in primary internal passage 70 will not be further transmitted to dampening device 73, shear device 75, etc. At this time, port blocking member 66 is still blocking ports 68, and seals 79 prevent flow from the bypass 64 through ports 68 and into internal flow passage 82. Flow passages 70 and 82 are both along an interior portion of well system 52, and differ in that they are separated from each other by ball valve 60, when ball valve 60 is in the closed position.

In order to open bypass 64 pressure in the internal primary flow passage 70 may be lowered, for instance to below the designated pressure point. As this occurs, the power piston 72 will begin to shift in the second direction (e.g. downwards), assisted in part by the counter force generated by dampening device 73 (which is directed towards shifting the power piston 72 downwards through actuator assembly 74). As power piston 72 shifts, actuator assembly 74 shifts and translates downwards forcing engagement member portion 76 to translate port blocking member 66 downwards as well. The bypass 64 begins to open once seals 79 partially open or 'crack' ports 68, thereby allowing flow to pass through bypass 64 and ports 68 and into internal flow passage 82. Once ports 68 are partially open, the pressure in internal primary flow passage 70 may partially equalize with that in internal flow passage 82, at which point the dampening device 73 counter force will act on power piston 72 and engagement member portion 76 to shift these downwards, and thereby fully open bypass 64.

Figure 6:
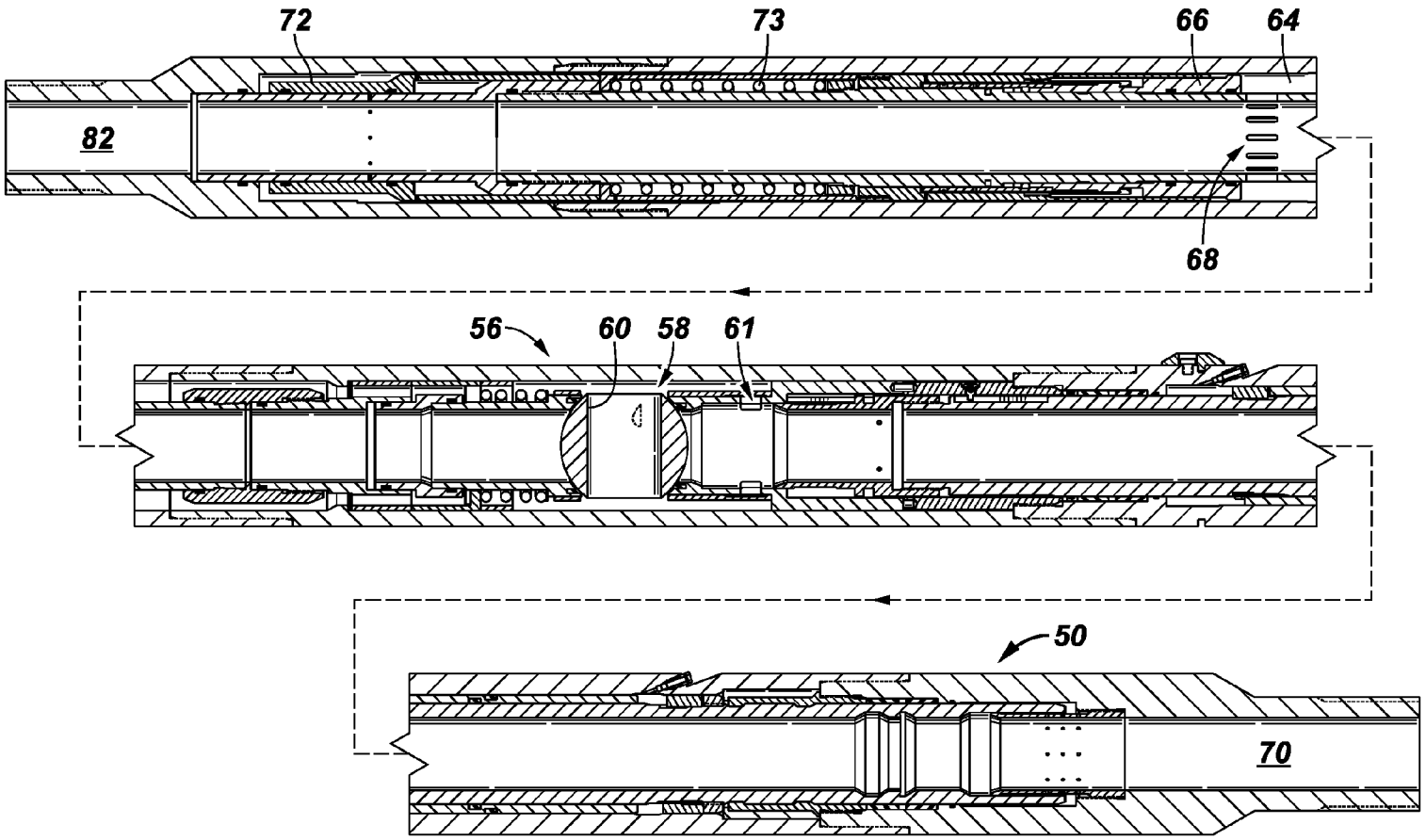
FIG. 6 is another illustration of an embodiment of an operational state of a barrier valve system with bypass option, according to an embodiment of the disclosure.

Referring now to FIG. 6, an embodiment of a system where bypass 64 is fully open is shown. Power piston 72 has shifted back to its initial position (e.g. downwards) and dampening device 73 is extended such that it is again able to provide counter force if necessary. Port blocking member 66 has shifted downwards to fully expose ports 68, and allow bypass 64 to fully open. With bypass 64 open, flow may proceed through internal primary flow passage 70, into bypass 64, around closed ball valve 60, through ports 68, into internal flow passage 82. With bypass 64 fully open, numerous well operations may be performed by bypassing ball valve 60. For instance, kill fluid may be pumped through bypass 64, around ball valve 60, down into the well in order to kill, or stop well production. Alternately, as bypass 64 provides a bidirectional flow path, bypass 64 could be used for production around a closed ball valve.

While a limited number of embodiments been described, those skilled in the art, having the benefit of this disclosure, will appreciate numerous modifications and variations there from. It is intended that the appended claims cover all such modifications and variations.

What is claimed is:

1. A flow control system for use in a wellbore well system, comprising:

a flow control assembly;

a bypass positioned to route fluid flow around the flow control assembly within the well system;

a flow bypass mechanism located along the bypass and positioned to selectively block flow along the bypass, the flow bypass mechanism being selectively displaceable to open the bypass in response to a designated increase in pressure within the flow control assembly;

a shear device restricting the opening of the bypass until the designated increase in pressure within the flow control assembly is reached;

a dampening device to limit the shear device exposure to force from pressure increases within the flow control assembly that are not intended to open the bypass;

a power piston suitable to shift in response to the pressure increase in the flow control assembly, wherein the dampening device initially limits the power piston shifting force from being transmitted to the shear device; and an actuator assembly, a portion of which is disposed between the dampening device and the power piston, and another portion of which is suitable to engage the shear device when the designated increase in pressure occurs within the flow control assembly.

2. The flow control system of claim 1, further comprising a variable adjustment member which allows the dampening device to be adjusted to respond to varying designated increases of pressure.

3. The flow control system of claim 1, further comprising an engagement member fixedly connected to the actuator assembly, the engagement member suitable to engage with the flow bypass mechanism after the designated increase in pressure occurs.

4. The flow control system of claim 1, wherein the flow control assembly comprises an in-line barrier valve in the form of a ball valve.

5. The flow control system of claim 1, wherein the flow bypass mechanism comprises a sliding sleeve valve.

6. The flow control system of claim 1, wherein the dampening device is a biasing member or a spring.

7. A method of controlling flow in a well system, comprising:

positioning a flow control assembly in a downhole well system;

providing a bypass around the flow control assembly;

controlling flow through the bypass with a flow bypass mechanism, wherein the flow bypass mechanism is selectively operated in response to a designated increase in pressure within the flow control assembly;

restricting the operation of the flow bypass mechanism with a shear device, the shear device suitable to shear in response to the designated increase in pressure, thereby allowing the bypass to open;

protecting the shear device with a dampening device, the dampening device suitable to limit the shear device's exposure to forces or translations related to pressure increases within the flow control assembly that are not intended to open the bypass;

increasing pressure in the flow control assembly to a point less than the designated pressure;

shifting a power piston in a first direction in response to the pressure increase, the power piston engaging with the dampening device so that limited force or displacement from the power piston is translated past the dampening device;

increasing pressure in the flow assembly to a point at or above the designated pressure;

shifting the power piston further, such that the dampening device allows force or displacement from the power piston to translate through the dampening device to the shear device; and shearing at least part of the shear device, thereby allowing an engagement member previously restrained by the shear device to engage with the flow bypass mechanism.

8. The method of claim 7, further comprising:

reducing pressure in the flow control assembly to a point less than the designated pressure;

shifting the power piston in a second direction in response to the pressure decrease;

transmitting the power piston shifting in the second direction to the engagement member and partially opening the flow bypass mechanism through the translation of the engagement member in the second direction; and continuing the shifting of the power position in the second direction through the addition of force provided by the dampening device.

9. The method of claim 7, further comprising protecting the shear device with a dampening device, the dampening device suitable to limit the shear device exposure to forces or translations arising from impacts or jarring of the flow control assembly during its deployment downhole.

10. The method of claim 7, wherein the flow control assembly comprises an in-line barrier valve in the form of a ball valve.

11. The method of claim 7, wherein the flow bypass mechanism comprises a sliding sleeve valve.

12. The method of claim 7, wherein the dampening device is a biasing member or a spring.

* * * * *